US012631094B2

(12) United States Patent
Allen et al.

(10) Patent No.: US 12,631,094 B2
(45) Date of Patent: May 19, 2026

(54) METHODS TO DYNAMICALLY CONTROL FLUID FLOW IN A MULTI-WELL SYSTEM, METHODS TO DYNAMICALLY PROVIDE REAL-TIME STATUS OF FLUID FLOW IN A MULTI-WELL SYSTEM, AND MULTI-WELL FLUID FLOW CONTROL SYSTEMS

(71) Applicant: Halliburton Energy Services, Inc., Houston, TX (US)

(72) Inventors: Clifford Allen, Spring, TX (US); Andrew Penno, Singapore (SG); Alejandro Javier Chacon, Houston, TX (US); John O'Hara, Cypress, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 1085 days.

(21) Appl. No.: 17/710,977

(22) Filed: Mar. 31, 2022

(65) Prior Publication Data

US 2023/0313647 A1 Oct. 5, 2023

(51) Int. Cl.
*E21B 43/12* (2006.01)
*E21B 41/00* (2006.01)

(52) U.S. Cl.
CPC ..... *E21B 43/12* (2013.01); *E21B 41/00* (2013.01); *E21B 2200/20* (2020.05)

(58) Field of Classification Search
CPC ..... E21B 43/12; E21B 41/00; E21B 2200/20
(Continued)

(56) References Cited

U.S. PATENT DOCUMENTS 5,587,707 A * 12/1996 Dickie ..... H04B 13/02 340/854.4
6,159,368 A * 12/2000 Moring ..... B01L 3/50255 422/258

(Continued)

FOREIGN PATENT DOCUMENTS

CN 106163682 B 9/2019
WO 200165068 A1 9/2001

(Continued)

OTHER PUBLICATIONS

Erge et al. ("Combining physics-based and data-driven modeling in well construction: Hybrid fluid dynamics modeling", Elsevier, 2021, pp. 1-14) (Year: 2021).*

(Continued)

*Primary Examiner* — Iftekhar A Khan
(74) *Attorney, Agent, or Firm* — Scott Richardson; C. Tumey Law Group PLLC

(57) ABSTRACT

A method to dynamically control fluid flow in a multi-well system includes receiving first fluid flow data indicative of fluid flow at a first node of a plurality of nodes, each node being a node along a well of a plurality of wells of a multi-well system, receiving second fluid flow data indicative of fluid flow at a second node of the plurality of nodes, analyzing the first fluid flow data and the second fluid flow data, determining an impact on fluid flow at the second node due to fluid flow at the first node, and determining, based on the impact, whether to adjust fluid flow at a node of the plurality of nodes. In response to a determination to adjust fluid flow at the node, the method further includes determining an adjustment to the fluid flow at the node; and requesting a fluid control device to make the adjustment.

19 Claims, 5 Drawing Sheets

(58) Field of Classification Search
USPC ..... 703/10
See application file for complete search history.

(56) References Cited

U.S. PATENT DOCUMENTS

| | | | | |
|---|---|---|---|---|
| 6,279,660 | B1 * | 8/2001 | Hay | E21B 43/14 166/336 |
| 7,640,149 | B2 * | 12/2009 | Rowan | G01V 11/00 703/2 |
| 8,170,801 | B2 * | 5/2012 | Foot | E21B 47/06 702/182 |
| 8,244,509 | B2 * | 8/2012 | Banerjee | E21B 43/00 702/11 |
| 8,290,632 | B2 * | 10/2012 | Briers | E21B 43/12 700/285 |
| 8,788,252 | B2 * | 7/2014 | Zhou | E21B 43/00 703/10 |
| 9,085,966 | B2 | 7/2015 | Rahman et al. | |
| 9,212,538 | B2 * | 12/2015 | Shetty | G01V 20/00 |
| 9,540,911 | B2 * | 1/2017 | Stone | E21B 43/00 |
| 10,013,512 | B2 * | 7/2018 | Bailey | G06F 30/20 |
| 10,215,014 | B2 * | 2/2019 | Dawson | E21B 47/06 |
| 10,337,283 | B2 * | 7/2019 | Gottumukkala | E21B 34/06 |
| 10,443,359 | B2 * | 10/2019 | DeValve | E21B 43/16 |
| 10,526,888 | B2 * | 1/2020 | Song | G01F 1/74 |
| 11,459,868 | B2 * | 10/2022 | Fan | E21B 7/04 |
| 11,514,216 | B1 * | 11/2022 | Sankaran | G06F 30/28 |
| 11,976,541 | B2 * | 5/2024 | Curry | E21B 41/00 |
| 2008/0065362 | A1 | 3/2008 | Lee et al. | |
| 2011/0040536 | A1 * | 2/2011 | Levitan | G01V 20/00 703/2 |
| 2014/0303950 | A1 * | 10/2014 | Houeto | E21B 43/00 703/10 |
| 2015/0083404 | A1 * | 3/2015 | Wilt | E21B 47/092 166/250.1 |
| 2016/0061003 | A1 | 3/2016 | Gottumukkala et al. | |
| 2016/0063146 | A1 * | 3/2016 | Bailey | G06Q 10/06 703/2 |
| 2017/0336811 | A1 * | 11/2017 | Stone | E21B 41/00 |
| 2017/0356283 | A1 * | 12/2017 | Al-Gouhi | E21B 47/09 |
| 2018/0209248 | A1 | 7/2018 | Patel et al. | |
| 2019/0093474 | A1 * | 3/2019 | Poonacha | E21B 43/00 |
| 2020/0284127 | A1 * | 9/2020 | Ismail | E21B 43/12 |
| 2020/0400010 | A1 * | 12/2020 | Le | E21B 49/008 |
| 2021/0087925 | A1 * | 3/2021 | Heidari | G06N 3/0442 |
| 2021/0332683 | A1 * | 10/2021 | Hunter | E21B 43/261 |
| 2021/0364669 | A1 * | 11/2021 | Dusterhoft | E21B 49/00 |
| 2022/0147674 | A1 * | 5/2022 | Sankaran | G06F 30/28 |
| 2022/0228466 | A1 * | 7/2022 | Watanabe | E21B 43/16 |
| 2022/0229403 | A1 * | 7/2022 | Goh | E21B 43/00 |

FOREIGN PATENT DOCUMENTS

| | | | | |
|---|---|---|---|---|
| WO | 2020246954 | A1 | 12/2020 | |
| WO | WO-2023191820 | A1 * | 10/2023 | E21B 43/12 |

OTHER PUBLICATIONS

International Search Report and Written Opinion in PCT/US2022/025129, mailed Dec. 28, 2022.

Application of Inflow Control Device (ICD) for Optimizing Horizontal Well Performance, Final Year Project II, Final Report, Universiti, Teknologi Petronas, Sep. 2012.

* cited by examiner

METHODS TO DYNAMICALLY CONTROL FLUID FLOW IN A MULTI-WELL SYSTEM, METHODS TO DYNAMICALLY PROVIDE REAL-TIME STATUS OF FLUID FLOW IN A MULTI-WELL SYSTEM, AND MULTI-WELL FLUID FLOW CONTROL SYSTEMS

BACKGROUND

The present disclosure relates generally to methods to dynamically control fluid flow in a multi-well system, methods to dynamically provide real-time status of fluid flow in a multi-well system, and multi-well fluid flow control systems.

Multi-well systems sometimes include multiple wells that traverse thousands of feet from the surface downhole. Further, different well operations are sometimes performed in different wells of multi-well systems. For example, a multi-well system may include one or more injection wells and one or more production wells that are in fluid communication with each other. Sensors and other devices are sometimes positioned at different nodes along a multi-well system to monitor the status of the multi-well system.

BRIEF DESCRIPTION OF THE DRAWINGS

Illustrative embodiments of the present disclosure are described in detail below with reference to the attached drawing figures, which are incorporated by reference herein, and wherein.

Figure 1:
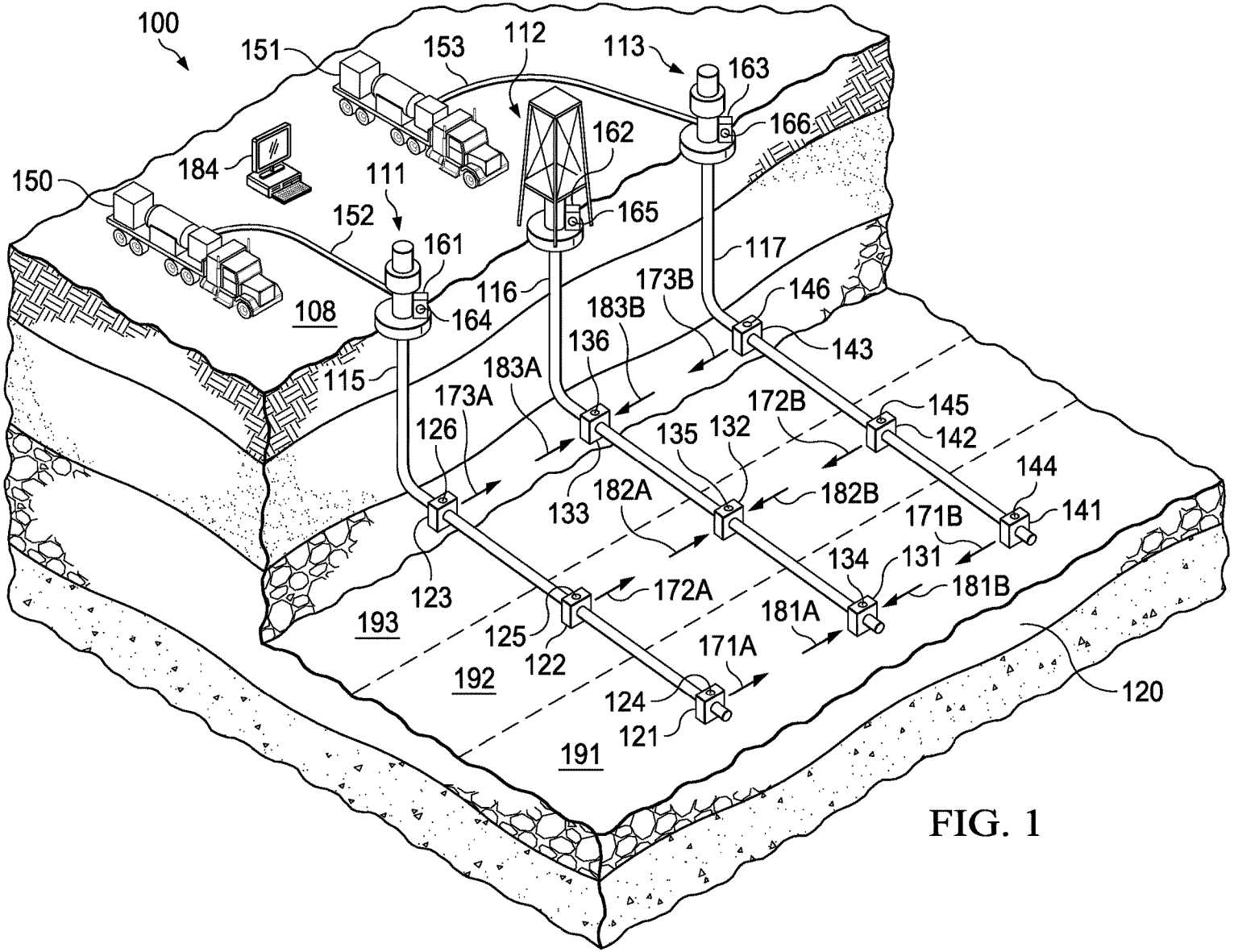
FIG. 1 is a schematic, side view of a multi-well environment that includes a production well and two injection wells.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to methods to dynamically control fluid flow in a multi-well system, methods to dynamically provide real-time status of fluid flow in a multi-well system and multi-well fluid flow control systems.

A multi-well system refers to any well environment that includes multiple wells including, but not limited to, production wells, injection wells, and other types of wells. Fluid monitors, such as sensors, gauges, and other types of devices that are configured to detect or monitor fluid flow at and/or around one or more nodes of wells of the multi-well system, are positioned at different downhole locations to monitor fluid flow at and/or near the one or more nodes. As referred to herein, a node is a location at or around a well location of a well. For example, where an injection well of a multi-well system has a first node that is 1,000 feet downhole, a first fluid monitor is positioned at or near the first node to dynamically monitor fluid flow near and at the first node. Similarly, where an adjacent production well of the multi-well system has a second node that is positioned 3,000 feet downhole, a second fluid monitor is positioned at or near the second node to dynamically monitor fluid flow near and at the second node. The fluid monitors dynamically provide data indicative of fluid flow at nodes they are configured to measure to a multi-well fluid control system.

The multi-well fluid control system dynamically analyzes the data obtained from the fluid monitors. In some embodiments, the multi-well fluid control system generates a data model of fluid flow through the multi-well system from data indicative of fluid flow through the nodes. In one or more of such embodiments, the multi-well fluid control system dynamically updates the data model based on real-time data indicative of the fluid flow and changes to the fluid flow at the nodes. Continuing with the foregoing example, the multi-well fluid control system generates the data model of the multi-well system based on real-time data indicative of fluid flow and changes in fluid flow at the first node, the second node, and other nodes of the multi-well system, and periodically or continuously updates the data model based on new data indicative of the fluid flow and changes in fluid flow at the first node, the second node, and other nodes of the multi-well system. In one or more of such embodiments, the multi-well fluid control system utilizes machine learning algorithms to generate and update the data model. In one or more of such embodiments, where a new well is added to the multi-well system, the multi-well fluid control system is configured to dynamically update the data model to include data indicative of fluid flow at one or more nodes of the new well.

In some embodiments, the multi-well fluid control system also obtains a physics model of the multi-well system. In one or more of such embodiments, the physics model is a pre-generated modeling of the multi-well fluid control system. In one or more of such embodiments, the physics model is dynamically generated by the multi-well fluid control system. In one or more of such embodiments, the multi-well fluid control system also dynamically updates the physics model based on data indicative of fluid flow and changes in the fluid flow at the nodes. In one or more of such embodiments, the multi-well fluid control system obtains a result of the physics model and adjusts a parameter of the data model based on the result of the physics model. Additional examples of operations performed by the multi-well fluid control system to generate or obtain data models and physics models of the multi-well system, and to update the data models and physics models of the multi-well system are provided herein.

In some embodiments, the multi-well fluid control system determines, based on the data obtained from the fluid monitors, relationships between different nodes of the multi-well system and changes in existing relationships between different nodes of the multi-well system. In one or more of such embodiments, the multi-well fluid control system utilizes the data model, the physics model, and/or a combination of the data model and physics model to establish and predict relationships and changes in the relationships between different nodes of the multi-well system. In some embodiments, the multi-well fluid control system determines, based on the data obtained from the fluid monitors, boundary conditions at or near different nodes of the different nodes of the multi-well system, and changes to existing boundary conditions at or near different nodes of the different nodes of the multi-well system. In one or more of such embodiments, the multi-well fluid control system utilizes the data model, the physics model, and/or a combination of the data model and physics model to establish and predict boundary conditions at or near different nodes of the different nodes of the multi-well system, and changes to existing boundary conditions at or near different nodes of the different nodes of the multi-well system.

The multi-well fluid control system dynamically determines an impact of fluid flow or change in fluid flow at one node due to fluid flow or change in fluid flow at other nodes. Examples of an impact include, but are not limited to, increase or decrease of fluid flow at one node due to fluid flow or a change in the fluid flow at other nodes, interference of fluid flow at one node due to the fluid flow or change in fluid flow at other nodes, crossflow prevention as a result of fluid flow or a change in the fluid flow at one or more nodes, crossflow prevention as a result of a change in the direction of fluid flow at one or more nodes, and/or other types of changes or a lack of change to fluid flow. Continuing with the foregoing example, the multiple-well fluid control system analyzes an impact on fluid flow or change in fluid flow at the second node due to fluid flow or change in fluid flow at or near first node. Continuing with the foregoing example, the multi-well fluid control system dynamically determines an increase or decrease in the flowrate of hydrocarbon fluids flowing through the second node towards the surface, an increase or decrease to the pressure of the hydrocarbon fluids flowing through the second node, as well as other impacts on the fluid flow of the hydrocarbon fluids and other types of fluids at the second node due to fluid flow or a change in the fluid flow of injection fluids or other types of fluids at the first node.

In some embodiments, where a data model of the multi-well system has been generated, and where a result of the data model is indicative of the impact on fluid flow at a node (e.g., the second node) due to fluid flow or changes in fluid flow at one or more other nodes (e.g., the first node), the multi-well fluid control system generates the data model to determine the impact on fluid flow at the node. Similarly, in some embodiments, where the data model of the multi-well system obtains or generates a physics model of the multi-well system, the multi-well fluid control system, and where a result of the physics model is indicative of the impact on fluid flow at a node, the multi-well system also determines the impact from the result of the physics model. In some embodiments, the multi-well fluid control system also analyzes the impact, determines an adjustment to one or more parameters of subsequent iterations of the physics model and/or the data model, and dynamically adjusts the physics model and/or the data model to account for the impact.

In some embodiments, the multi-well fluid control system not only utilizes the generated data model and the physics model to determine fluid flow at one or more nodes, and changes in fluid flow at the one or more nodes, but also to determine boundary conditions at or near the one or more nodes, and relationships between the one or more nodes. In some embodiments, the multi-well fluid control system also utilizes the generated data model and the physics model to generate different current and future production and other types of operational related scenarios. In some embodiments, the multi-well fluid control system also utilizes the generated data model and the physics model to generate improvement and optimization scenarios to improve or optimize production and other well operations performed at the multi-well system. In one or more of such embodiments, the multi-well fluid control system utilizes the data model and the physics model to map desired and optimal placement locations of new fluid control devices to improve or optimize existing production operations. In one or more of such embodiments, the multi-well fluid control system also utilizes the data model and the physics model to map desired or optimal placement locations of new wells or work over wells to improve or optimize future production operations. In one or more of such embodiments, the multi-well fluid control system also utilizes the data model and the physics model to map desired or optimal placement locations of new wells or work over wells to improve or optimize existing reservoir drainage plan. Additional descriptions of the data model and the physics model and how the multi-well fluid control system also utilizes the data model and the physics model are provided in the paragraphs herein.

The multi-well fluid control system determines whether to adjust fluid flow at a node due to the determined impact. In some embodiments, the multi-well fluid control system determines to adjust the fluid flow at the node if the impact is greater than a threshold impact. For example, where the threshold impact at the second node is a decrease in fluid flow of production fluid by more than 100 gallons per minute, the multi-well fluid control system determines to increase fluid flow of injection fluids at a third node of the injection well (or another node) in response to a determination that fluid flow of production fluid at the second node has decreased by 150 gallons per minute or by another rate that is greater than 100 gallons per minute.

The multi-well fluid control system, in response to a determination to adjust fluid flow at the node, determines what fluid flow adjustment should be made at the node, and requests a fluid control device to make the determined adjustment. As referred to herein, a fluid control device is any device or component configured to restrict, control, and/or permit fluid flow at or through one or more nodes of the multi-well system. Examples of fluid control devices include, but are not limited to, safety valves, chemical injection devices, artificial lifts, zonal isolation devices, downhole interval control valves, inflow control valves, autonomous inflow control devices, fluid pumps, devices and components used for stream injection operations (such as outflow control components), fluid restrictors, hydraulic control systems, and other types of devices or components configured to restrict, control, and/or permit fluid flow at or through one or more nodes of the multi-well system.

In some embodiments, the multi-well fluid control system determines multiple adjustments to the fluid flow at one or more nodes of the multi-well system and ranks predicted results of the adjustments of the fluid flow. Continuing with the foregoing example, the multi-well fluid control system, upon determining that increasing the pump rate of a pump at the surface of the injection well would increase the flow rate at the second node by 50 gallons per minute, shifting a valve positioned at the first node would increase the flow rate at the second node by 100 gallons per minute, and closing a valve at a third node would increase the flow rate at the second node by 150 gallons per minute, ranks the three adjustment options based on the increase in flow rate at the second node. Additional examples of ranking categories include, but are not limited to, total fluid production at a node, at a well, and/or at the multi-well system, future production (e.g., production in six months or another future date, or production within the next month or another future time frame) at a node, at a well, and/or at the multi-well system, production efficiency at a node, at a well, and/or at the multi-well system, future production efficiency at a node, at a well, and/or at the multi-well system, operational cost, equipment wear and tear, and/or rankings based on other types of fluid flow, fluid production, and equipment or operation related metrics.

In one or more of such embodiments, the multi-well fluid control system continuously or periodically updates the ranking of the adjustments based on real-time data. In one or more of such embodiments, the multi-well fluid control system also generates one or more recommendations of a preferred adjustment based on the real-time data to improve or optimize fluid flow, reduce or optimize operational cost, improve or optimize equipment and well operational expectancy, and to improve or optimize other fluid flow or operational metrics. In one or more of such embodiments, the multi-well fluid control system utilizes a neural network to dynamically generate and update the one or more recommendations. In one or more of such embodiments, the multi-well fluid control system provides the generated ranking and recommendations for display on an electronic device of an operator for the operator. In one or more of such embodiments, the multi-well fluid control system, in response to receiving an input from the operator indicative of a selection of a recommended adjustment, requests a fluid control device to make the recommended adjustment.

In one or more of such embodiments, the multi-well fluid control system also determines additional nodes within the multi-well system to place new fluid control devices to improve existing fluid flow, improve or optimize production, and improve or optimize other operational aspects of the multi-well system, and provides one or more recommendations on how to improve the multi-well system by incorporating new fluid control devices. In some embodiments, the multi-well fluid control system dynamically determines an adjustment based on the data model and the physics model, and dynamically requests one or more fluid control devices to make the determined adjustment. Additional descriptions of the foregoing methods to dynamically control fluid flow in a multi-well system, methods to dynamically provide real-time status of fluid flow in a multi-well system and multi-well fluid flow control systems are described in the paragraphs below and are illustrated in FIGS. 1-5.

Turning now to the figures, FIG. 1 is a schematic, side view of a multi-well environment 100 that includes a production well and two injection wells 111 and 113. As shown in FIG. 1, wellbores 115, 116, and 117 of injection well 111, production well 112, and injection well 113 extend from surface 108 of injection well 111, production well 112, and injection well 113, respectively, to a subterranean substrate or formation 120. In the embodiment illustrated in FIG. 1, wellbores 115, 116, and 117 traverse through first zone 191, second zone 192, and third zone 193. Further, in the embodiment illustrated in FIG. 1, wellbores 115, 116, and 117 have been formed by a drilling process in which dirt, rock and other subterranean materials are removed to create wellbores 115, 116, and 117. In some embodiments, a portion of each of wellbores 115, 116, and 117 is cased with a casing. In other embodiments, wellbores 115, 116, and 117 are maintained in an open-hole configuration without casing. The embodiments described herein are applicable to either cased or open-hole configurations of wellbores 115, 116, and 117, or a combination of cased and open-hole configurations in a particular wellbore. In some embodiments, some or each of injections wells 111 and 113 and production well 112 also include conveyances such as production tubing that traverse their respective wellbores 115, 117, and 116, respectively, to provide a fluid passage.

In the embodiment of FIG. 1, injection fluids flow from fluid sources 150 and 151, via inlet conduits 152 and 153, respectively, into wellbores 115 and 117. Injection fluids that flow into wellbore 115 are subsequently injected into formation 120 at nodes 124, 125, and 126, respectively, such as, for example, in the directions illustrated by arrows 171A, 172A, and 173A, respectively, into formation 120. The injection fluids that are injected into formation 120 from nodes 124, 125, and 126 facilitate or cause fluid flow or a change in the fluid flow of production fluids such as hydrocarbon resources into wellbore 116, such as, for example, in the directions illustrated by arrows 181A, 182A, and 183A, respectively, into wellbore 112 at nodes 134, 135, and 136, respectively. In the embodiment of FIG. 1, a pump (not shown) that is positioned at surface node 164 of well injection 111, facilitates fluid flow of injection fluids down wellbore 115, and into formation 120 at nodes 134, 135, and 136. Similarly, injection fluids that flow into wellbore 115, are subsequently injected into formation 120 at nodes 144, 145, and 146, respectively, such as, for example, in the directions illustrated by arrows 171B, 172B, and 173B, respectively, into formation 120. The injection fluids that are injected into formation 120 from nodes 144, 145, and 146 facilitate or cause fluid flow or a change in the fluid flow of production fluids such as hydrocarbon resources into wellbore 116, such as, for example, in the directions illustrated by arrows 181B, 182B, and 183B, respectively, into wellbore 116 at nodes 134, 135, and 136, respectively. In the embodiment of FIG. 1, a pump (not shown) that is positioned at surface node 166 of injection well 113 facilitates fluid flow of injection fluids down wellbore 117, and into formation 120 at nodes 134, 135, and 136. Fluids flow into wellbore 116, up wellbore 116 toward surface 108, where the fluids eventually flow out of production well 112 through an outlet conduit (not shown) to a fluid container (not shown).

During the operations illustrated in FIG. 1, fluid monitors 121-123, 131-133, 141-143, and 161-163 that are positioned at nodes 124-126, 134-136, 144-146, and 164-166, respectively, continuously or periodically obtain data indicative of fluid flow or change in fluid flow at or near nodes 124-126, 134-136, 144-146, and 164-166, respectively. For example, fluid monitor 161 obtains fluid flow at surface node 164 of injection well 111 down wellbore 115??, fluid monitor 121 obtains fluid flow at node 124 of injection well 111 and into first zone 191, fluid monitor 122 obtains fluid flow at node 125 of injection well 111 and into second zone 192, and fluid monitor 123 obtains fluid flow at node 126 of injection well 111 and into formation 120. Further, fluid monitor 131 obtains fluid flow into production well 112 at node 134, fluid monitor 132 obtains fluid flow into production well 112 at node 135, and fluid monitor 133 obtains fluid flow into production well 112 at node 136. Data indicative of fluid flow and changes to fluid flow at nodes 124-126, 134-136, 144-146, and 164-166 are transmitted via wireless, wired, optical, acoustic, or other types of telemetry to a multi-well fluid flow control system 184. As referred to herein, multi-well fluid flow control system 184 includes any electronic device configured to perform operations described herein to dynamically control fluid flow in a multi-well system, such as the multi-well system illustrated in FIG. 1, and dynamically provide a status of fluid flow in the multi-well system. Examples of multi-well fluid flow control system 184 include, but are not limited to, desktops, laptops, server computers, edge computers, tablet computers, smart phones, and other types of electronic devices that are configured to perform operations described herein to dynamically control fluid flow in a multi-well system, such as the multi-well system illustrated in FIG. 1, and dynamically provide a status of fluid flow in the multi-well system. In some embodiments, multi-well fluid flow control system 184 is formed from multiple electronic devices (not shown). In some embodiments, some or all of multi-well fluid flow control system 184 reside in a downhole location or in the cloud.

Multi-well fluid flow control system 184 dynamically analyzes fluid flow data obtained from fluid monitors 121-123, 131-133, 141-143, and 161-163 to determine an impact on fluid flow at any of nodes 124-126, 134-136, 144-146, and 164-166 due to fluid flow or change in fluid flow at one or more of the other nodes 124-126, 134-136, 144-146, and 164-166. For example, after injection well 113 is added to an existing multi-well system that contains injection well 111 and production well 112, a valve (not shown) at node 146 is shifted to an open position to provide fluid flow from node 146 into formation 120. After the valve at node 146 is shifted to the open position, multi-well fluid flow control system 184 dynamically analyzes fluid flow at and near nodes 124-126, 134-136, 144-146, and 164-166 to determine fluid flow and changes to fluid flow at and near nodes 124-126, 134-136, 144-146, and 164-166. In some embodiments, multi-well fluid flow control system 184 also dynamically generates a data model of the multi-well fluid flow control system that includes injection well 111, production well 112, and injection well 113 based on data indicative of fluid flow and changes in fluid flow that are obtained by fluid monitors 121-123, 131-133, 141-143, and 161-163. In some embodiments, multi-well fluid flow control system 184 also dynamically updates the data model based on new data indicative of fluid flow and changes in fluid flow that are obtained by fluid monitors 121-123, 131-133, 141-143, and 161-163.

In some embodiments, multi-well fluid flow control system 184 also obtains or generates a physics model of the multi-well fluid flow control system 184 that includes injection well 111, production well 112, and injection well 113 based on data indicative of fluid flow and changes in fluid flow that are obtained by fluid monitors 121-123, 131-133, 141-143, and 161-163. In some embodiments, multi-well fluid flow control system 184 also dynamically updates the physics model based on new data indicative of fluid flow and changes in fluid flow that are obtained by fluid monitors 121-123, 131-133, 141-143, and 161-163. In some embodiments, multi-well fluid flow control system 184 compares the physics model and the data model. In one or more of such embodiments, multi-well fluid flow control system 184 adjusts a parameter of the data model based on a result of the physics model. In another one of such embodiments, multi-well fluid flow control system 184 adjusts a parameter of the physics model based on a result of the data model.

Multi-well fluid flow control system 184 determines one or more adjustments in response to the impact. Continuing with the foregoing example, where fluid flow of production fluids into wellbore 116 at nodes 134-136 was consistently 1,000 gallons per minute, and where, after the valve at node 136 is shifted open, fluid flow of production fluids into wellbore 116 at nodes 134-136 changed to 600 gallons per minute, 900 gallons per minute, and 1,200 gallons per minute respectively, multi-well fluid flow control system 184 dynamically determines one or more adjustments to the fluid control devices that are positioned at nodes 124-126, 134-136, 144-146, and 164-166 and other fluid control devices (not shown) of the multi-well fluid flow control system 184 in response to the change in the fluid flow of production fluids into wellbore 116 at nodes 134-136.

In some embodiments, multi-well fluid flow control system 184 utilizes the data model, the physics model, and/or a combination of the data model and the physics model to determine one or more adjustments in response to the impact. Continuing with the foregoing example, multi-well fluid flow control system 184 modifies a parameter of the data model and the physics model of the multi-well system to simulate a first adjustment that includes shifting the valve at node 146 to a half open position, and determines the impact on fluid flow at nodes 124-126, 134-136, 144-146, and 164-166 due to shifting the valve at node 146 to a half open position. Similarly, multi-well fluid flow control system 184 modifies a second parameter of the data model and the physics model of the multi-well system to simulate a second adjustment that includes shifting a second valve at node 144 to enlarge the opening of the second valve and determines the impact on fluid flow at nodes 124-126, 134-136, 144-146, and 164-166 due to shifting the valve at node 142 to a half open position. Similarly, multi-well fluid flow control system 184, in addition to modifying the first and the second parameter, also modifies a third parameter of the data model and the physics model of the multi-well system to simulate a third adjustment that includes simultaneously performing the foregoing operations related to the first and the second parameters, and also shifting a third valve at node 124 of injection well 111 to enlarge the opening of the third valve, and determines the impact on fluid flow at nodes 124-126, 134-136, 144-146, and 164-166 due to simultaneously shifting the valve at node 142 to a half open position, and further opening the second valve and the third valve at nodes 144 and 124, respectively.

In some embodiments, multi-well fluid flow control system 184 generates a ranking of the multiple adjustments based on total flow of production fluids out of production well 112, flow consistency of production fluids into production well 112 at nodes 134-136, cost of operation, wear and tear on equipment, and other applicable categories. In one or more of such embodiments, multi-well fluid flow control system 184 also provides one or more recommendations on the proposed adjustments for display on a display screen of an operator's electronic device. In one or more of such embodiments, multi-well fluid flow control system 184 also provides the data model and the physics model and simulations of the data model and the physics model for display on the operator's electronic device. In one or more of such embodiments, multi-well fluid flow control system 184 also provides additional information regarding the multi-well system, including relationships between different nodes, relationships between fluid flow at the different nodes, and relationships between different fluid control devices at the different nodes, boundary conditions at or near the different nodes (e.g., boundary condition at first, second, and third zones 191, 192, and 193, respectively), and other information regarding the multi-well system for display on the operator's electronic device. In one or more of such embodiments, multi-well fluid flow control system 184, in response to receiving an input from the operator to make a recommended adjustment, or make a new adjustment provided by the operator, requests the corresponding fluid control devices to make the received adjustment.

In some embodiments, multi-well fluid flow control system 184 dynamically determines an adjustment and requests the corresponding fluid control devices to make the determined adjustment. Continuing with the foregoing example, where the operator determines or multi-well fluid flow control system 184 dynamically determines to shift the valve at node 146 to a half open position, multi-well fluid flow control system 184, in response to receiving the operator's instructions, or in response to dynamically making the determination, transmits an instruction to the valve at node 146 to shift to a half open position. Additional descriptions of operations performed by multi-well fluid flow control system 184 are provided herein and are illustrated in at least FIGS. 2-5.

Although FIG. 1 illustrates a multi-well system having one production well 112 and two injection wells 111 and 113, in some embodiments, the multi-well system includes a different combination of injection, production, and/or other types of wells. For example, a similar multi-well system includes a $CO_2$ observation well in lieu of production well 112, and injection wells 111 and 113 are $CO_2$ injection wells. Moreover, operations described herein are performed at one or more nodes of such multi-well system to determine and demonstrate applicability in a network of carbon capture wells. Further, although each of injections wells 111 and 113 and production well 112 of FIG. 1 has four fluid monitors positioned at four nodes, in some embodiments, injections wells 111 and 113 and production well 112 have a different number of fluid monitors (not shown) positioned at or near different nodes (not shown). Similarly, in some embodiments, fluid control devices (not shown) of injections wells 111 and 113 and production well 112 are positioned at or near different nodes (not shown). In some embodiments, fluid monitors 121-123, 131-133, 141-143, and 161-163 are components of multi-well fluid flow control system 184. Similarly, in some embodiments, fluid control devices deployed in injections wells 111 and 113 and production well 112 are also components of multi-well fluid flow control system 184.

Figure 2:
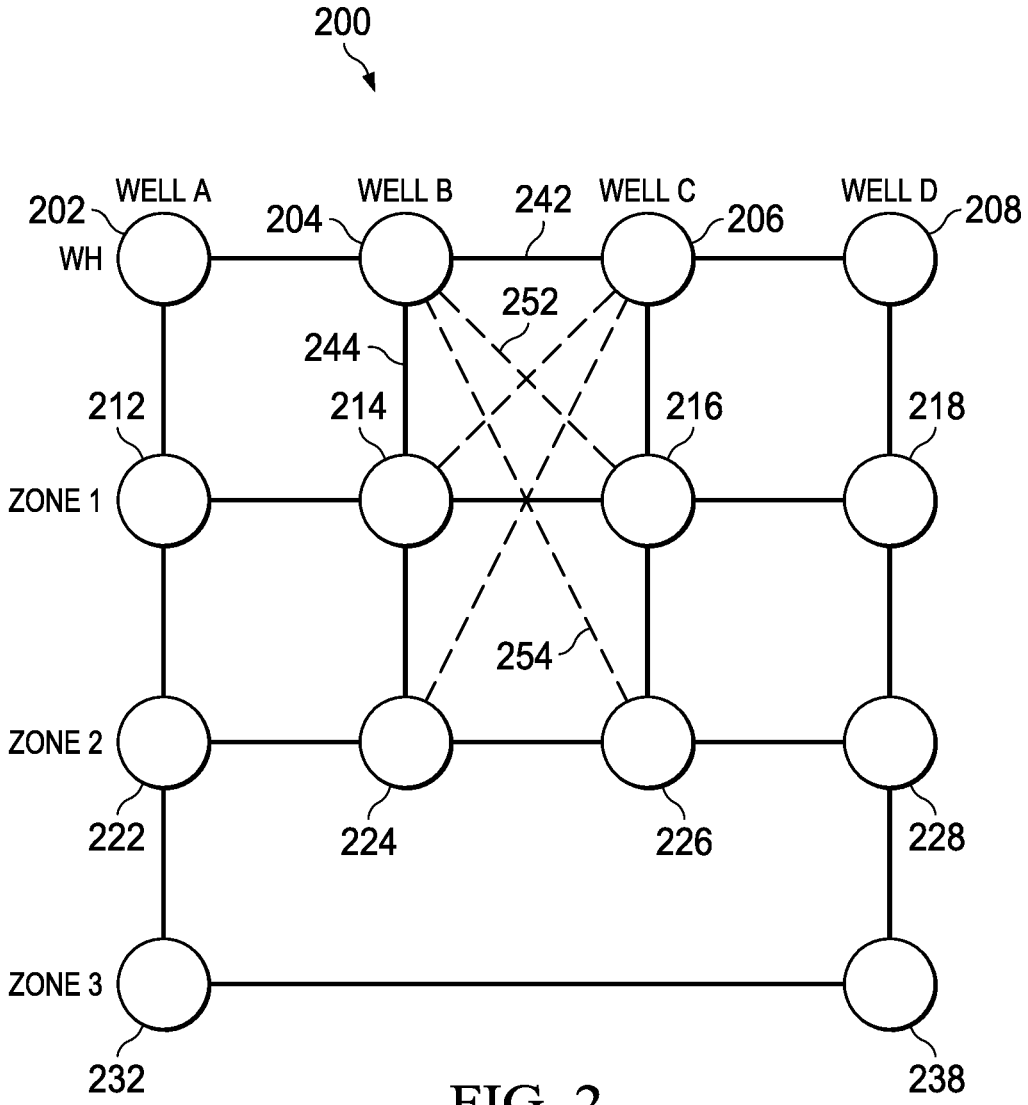
FIG. 2 is an illustration of a network of fluid monitors deployed at different nodes of a multi-well system having four wells.

FIG. 2 is an illustration of a network 200 of fluid monitors deployed at different nodes of a multi-well system having four wells. Examples of fluid monitors include, but are not limited to, sensors, gauges, and other types of devices that are configured to detect or monitor fluid flow at and/or around one or more nodes of wells of the multi-well system. In the embodiment of FIG. 2, fluid monitors 202, 212, 222, and 232 are deployed at the wellhead of Well A and in zones 1, 2, and 3, respectively. Further, fluid monitors 204, 214, and 224 are deployed at the wellhead of Well B and in zones 1 and 2, respectively. Further, fluid monitors 206, 216, and 226 are deployed at the wellhead of Well C and in zones 1 and 2, respectively. Further, fluid monitors 208, 218, 228, and 238 are deployed at the wellhead of Well D and in zones 1, 2, and 3, respectively. Solid lines, including solid lines 242 and 244 represent primary relationships between different fluid monitors 202, 204, 206, 208, 212, 214, 216, 218, 222, 224, 226, 228, 232, and 238. Further, dash lines, including dash lines 252 and 254 represent secondary relationships between fluid monitors 204, 206, 214, 216, 224, and 226. In the embodiment of FIG. 2, a multi-well fluid flow control system such as multi-well fluid flow control system 184 of FIG. 1, in addition to obtaining data indicative of fluid flow and changes in fluid flow from fluid monitors 202, 204, 206, 208, 212, 214, 216, 218, 222, 224, 226, 228, 232, and 238, also determines relationships between different fluid monitors 202, 204, 206, 208, 212, 214, 216, 218, 222, 224, 226, 228, 232, and 238, such as primary and secondary relationships illustrated by the solid and dash lines. Moreover, the multi-well fluid flow control system analyzes fluid flow and change in fluid flow through nodes monitored by fluid monitors 202, 204, 206, 208, 212, 214, 216, 218, 222, 224, 226, 228, 232, and 238 based on the relationships between fluid monitors 202, 204, 206, 208, 212, 214, 216, 218, 222, 224, 226, 228, 232, and 238. Similarly, models generated and updated by the multi-well fluid flow control system, such as the data model and the physics model also include parameters that take into account of different relationships between fluid monitors 202, 204, 206, 208, 212, 214, 216, 218, 222, 224, 226, 228, 232, and 238. Further, the relationships between fluid monitors 202, 204, 206, 208, 212, 214, 216, 218, 222, 224, 226, 228, 232, and 238 are utilized to determine an impact of fluid flow at one node that is monitored by a fluid monitor due to a change in fluid flow at another node that is monitored by a different fluid monitor. Further, the relationships between fluid monitors 202, 204, 206, 208, 212, 214, 216, 218, 222, 224, 226, 228, 232, and 238 are also utilized to determine whether to adjust fluid flow at a particular node, what adjustment should be made, and request one or more flow control devices to make the determined adjustments.

Figure 3:
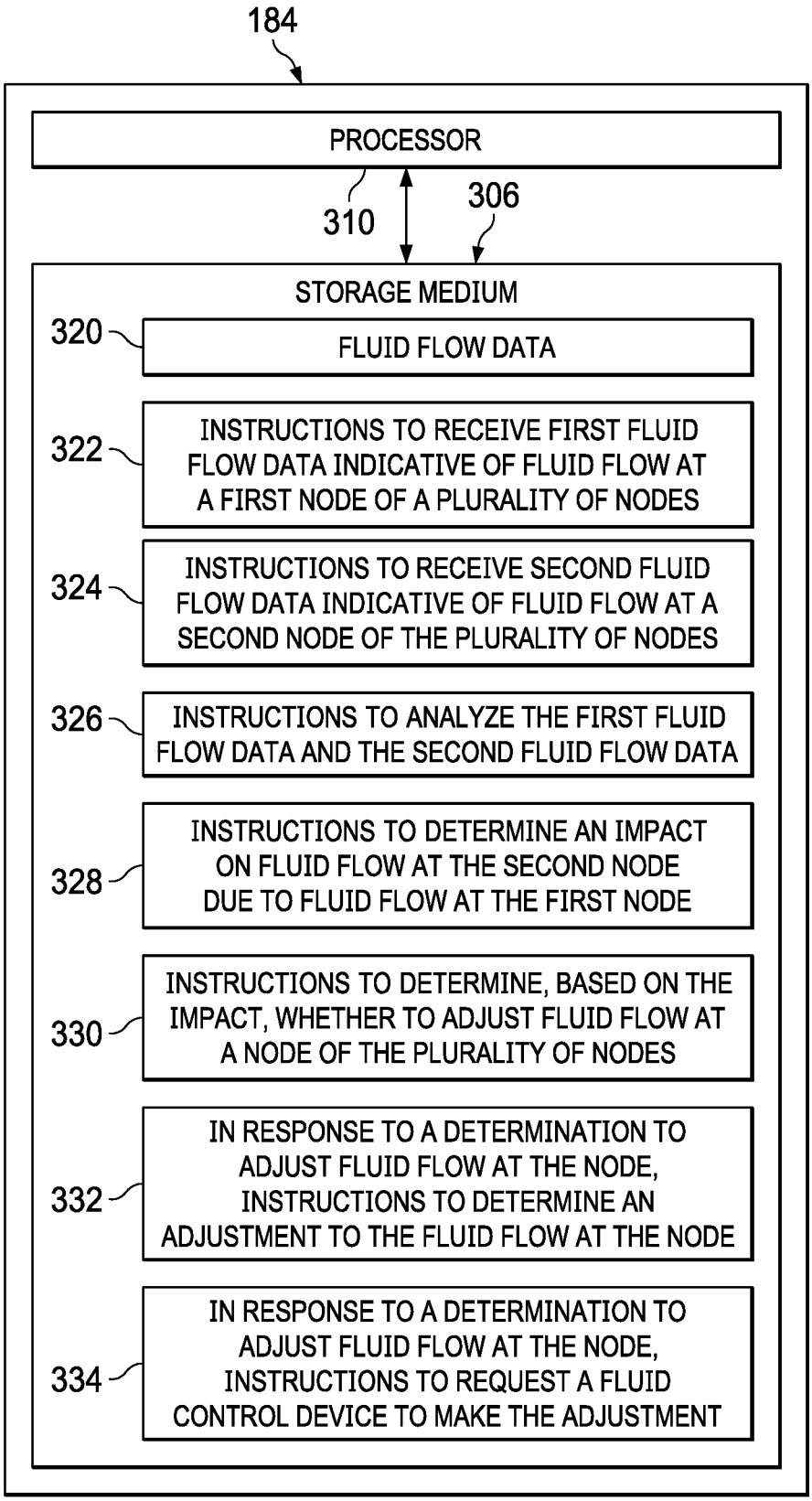
FIG. 3 is a block diagram of the multi-well fluid flow control system of FIG. 1.
Figure 4:
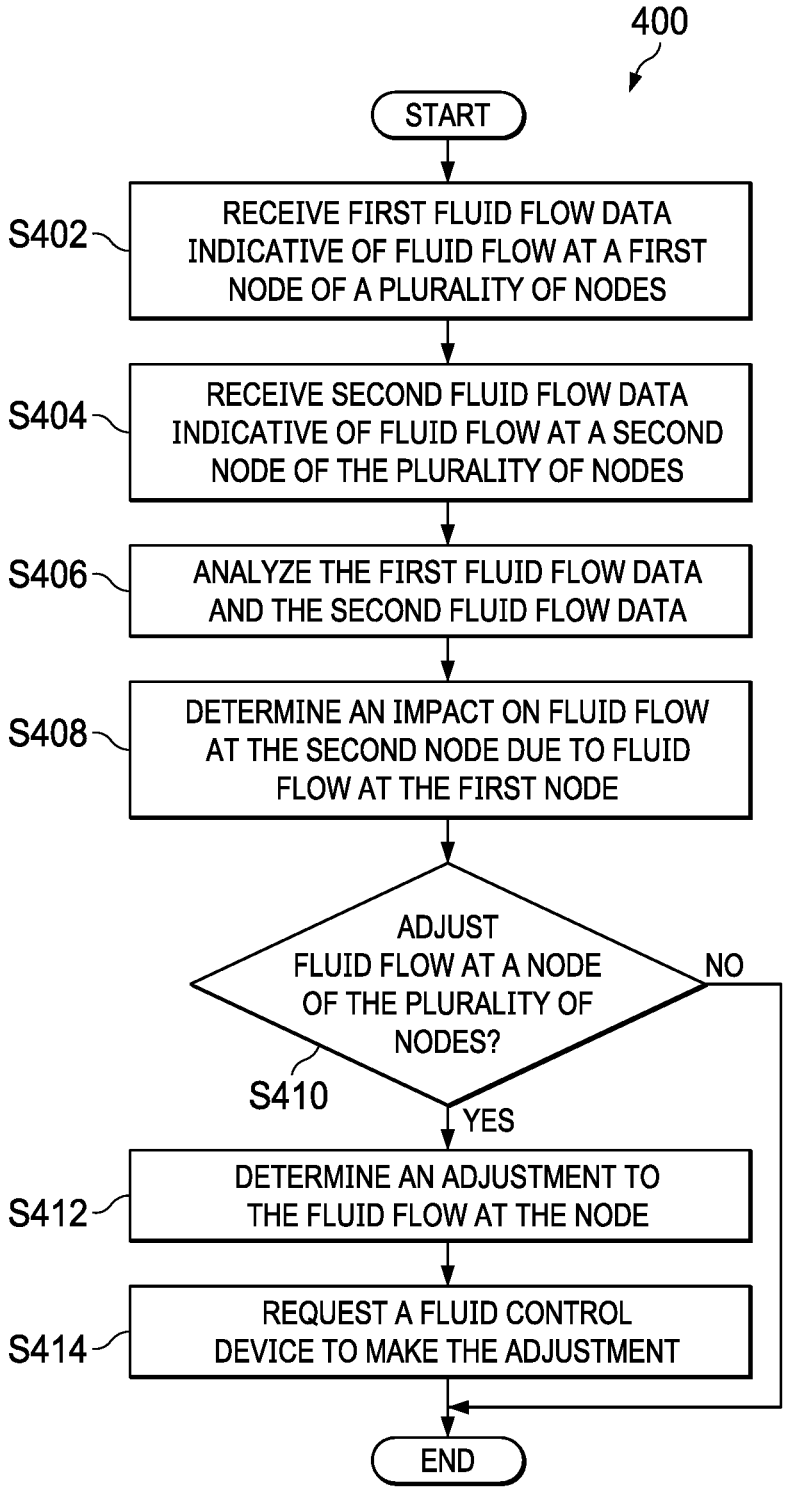
FIG. 4 is a flow chart of a process to dynamically control fluid flow in a multi-well system.
Figure 5:
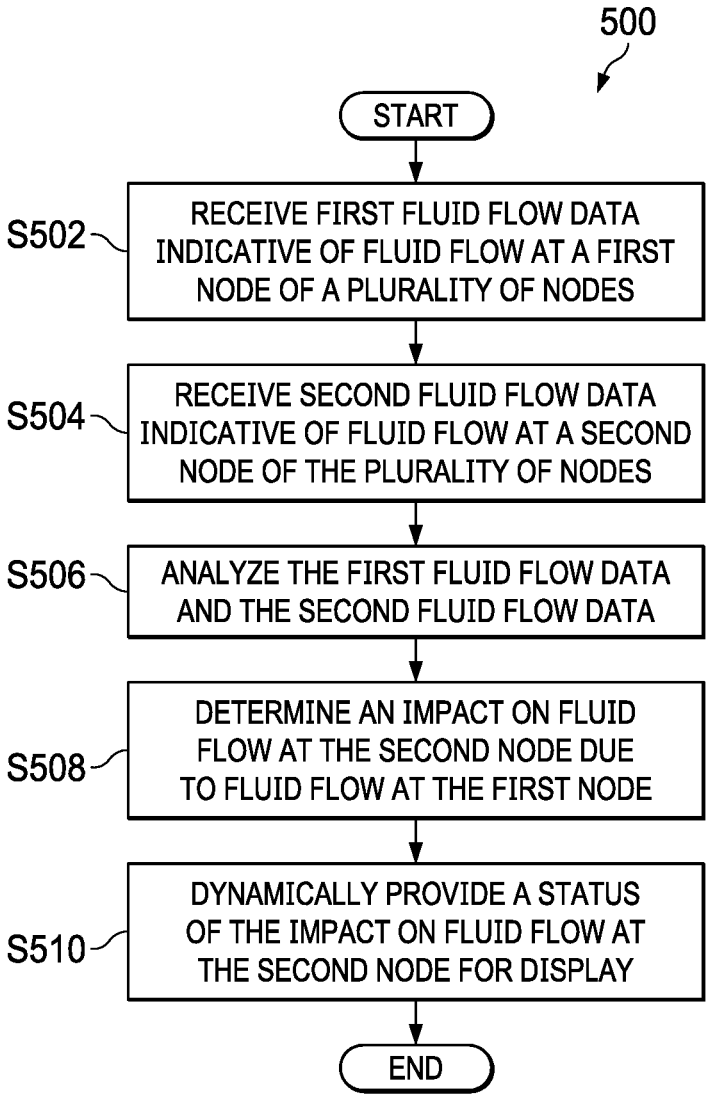
FIG. 5 is a flow chart of a process to dynamically provide real-time status of fluid flow in a multi-well system.

FIG. 3 is a block diagram of multi-well fluid flow control system 184 of FIG. 1, where multi-well fluid flow control system 184 is operable of performing the operations illustrated in processes 400 and 500 of FIGS. 4 and 5. The multi-well fluid flow control system 184 includes a storage medium 306 and a processor 310. The storage medium 306 may be formed from data storage components such as, but not limited to, read-only memory (ROM), random access memory (RAM), flash memory, magnetic hard drives, solid state hard drives, CD-ROM drives, DVD drives, floppy disk drives, as well as other types of data storage components and devices. In some embodiments, the storage medium 306 includes multiple data storage devices. In further embodiments, the multiple data storage devices may be physically stored at different locations. In one of such embodiments, the data storage devices are components of a server station, such as a cloud server.

Data indicative of fluid flow and changes in the fluid flow at or near different nodes of a multi-well system (collectively referred to as fluid flow data) such as the multi-well fluid flow control system illustrated in FIG. 1 are stored at a first location 320 of storage medium 306. Further, instructions to receive first fluid flow data indicative of fluid flow at a first node of a plurality of nodes are stored at a second location 322 of storage medium 306. Further, instructions to receive second fluid flow data indicative of fluid flow at a second node of the plurality of nodes are stored at a third location 324 of storage medium 306. Further, instructions to analyze the first fluid flow data and the second fluid flow data are stored at a fourth location 326 of storage medium 306. Further, instructions to determine an impact on fluid flow at the second node due to fluid flow at the first node are stored at a fifth location 328 of storage medium 306. Further, instructions to determine, based on the impact, whether to adjust fluid flow at a node of the plurality of nodes are stored at a sixth location 330 of storage medium 306. Further, in response to a determination to adjust fluid flow at the node, instructions to determine an adjustment to the fluid flow at the node are stored at a seventh location 332 of the storage medium. Further, in response to a determination to adjust fluid flow at the node, instructions to request a fluid control device to make the adjustment are stored at an eighth location 334 of the storage medium. Further, additional instructions that are performed by the processor 310 are stored in other locations of the storage medium 306.

FIG. 4 is a flow chart of a process 400 to determine an activity associated with an object of interest. Although the operations in process 400 are shown in a particular sequence, certain operations may be performed in different sequences or at the same time where feasible. As described below, process 400 provides an intuitive way for determining an activity associated with an object of interest.

At block S402, first fluid flow data indicative of fluid flow at a first node of a plurality of nodes are received. In that regard, multi-well fluid flow control system 184 of FIG. 1 receives from fluid monitor 143 of FIG. 1 first fluid flow data indicative of fluid flow at a first node, such as at node 146 of injection well 113 of FIG. 1. At block S404, second fluid flow data indicative of fluid flow at a second node of the plurality of nodes is received. In that regard, multi-well fluid flow control system 184 also receives from fluid monitor 132 of FIG. 1 second fluid flow data indicative of fluid flow at a second node, such as at node 135 of production well 112 of FIG. 1.

At block S406, the first fluid flow data and the second fluid flow data are analyzed. Further, at block S408, an impact on fluid flow at the second node due to fluid flow at the first node is determined. In that regard, multi-well fluid flow control system 184 of FIG. 1 analyzes the fluid flow data indicative of fluid flow and change in fluid flow at nodes 146 and 135, and determines an impact of fluid flow at node 135 due to fluid flow at node 146. In some embodiments, multi-well fluid flow control system 184 also generates a data model of the fluid flow of the multi-well system based on the fluid flow at different nodes of the multi-well system, and utilizes a result of the data model to determine an impact of fluid flow at one node due to another node. In some embodiments, multi-well fluid flow control system 184 also utilizes or generates a physics model of the fluid flow of the multi-well system based on the fluid flow at different nodes of the multi-well system and utilizes a result of the data model to determine an impact of fluid flow at one node due to another node. In some embodiments, multi-well fluid flow control system 184 of FIG. 1 utilizes a combination of a physics model and a data model to determine an impact of fluid flow at one node due to another node. In one or more of such embodiments, multi-well fluid flow control system 184 compares the physics model of the multi-well system with the data model of the multi-well system and adjusts one or more parameters of one model (data model or physics model) based on the results of the other model (physics model or data model) to improve the result of the model or to improve the resemblance of the two models.

At block S410, a determination of whether to adjust fluid flow at a node of the plurality of nodes of the multi-well system is made based on the impact. In some embodiments, the determination is made by an operator after the operator reviews recommendations provided by the multi-well fluid flow control system. In one or more of such embodiments the additional information regarding the multi-well system including, but not limited to, proposed adjustments, rankings of the proposed adjustments based on one or more ranking types described herein, and operator adjustment modellings of the data model and physics model of the multi-well system are provided for display on an electronic device of the operator to help the operator determine whether to adjust the fluid flow at a particular node or at multiple nodes of the multi-well system. In some embodiments, multi-well fluid flow control system 184 of FIG. 1 dynamically determines whether to adjust the fluid flow at the node. The process then proceeds to block S412 in response to a determination to adjust the fluid flow at the node. At block S412, an adjustment to the fluid flow at the node is determined. In some embodiments, the adjustment is selected by the operator from a ranked list of adjustments provided to the user. In some embodiments, multi-well fluid flow control system 184 dynamically determines the adjustment to the fluid flow at the node. At block S414 a request to make the adjustment is made to a fluid control device. For example, multi-well fluid flow control system 184 of FIG. 1 requests a valve positioned at node 146 of injection well 113 of FIG. 1 to shift to a closed position to improve fluid flow into node 135 of production well 112 of FIG. 1.

FIG. 5 is a flow chart of a process 500 to determine an activity associated with an object of interest. Although the operations in process 500 are shown in a particular sequence, certain operations may be performed in different sequences or at the same time where feasible. As described below, process 500 provides an intuitive way for determining an activity associated with an object of interest.

At block S502, first fluid flow data indicative of fluid flow at a first node of a plurality of nodes are received. At block S504, second fluid flow data indicative of fluid flow at a second node of the plurality of nodes is received. At block S506, the first fluid flow data and the second fluid flow data are analyzed. Further, at block S508, an impact on fluid flow at the second node due to fluid flow at the first node is determined. The operations performed at blocks S502, S504, S506, and S508 are similar or identical to the operations performed at blocks S402, S404, S406, and S408, which are described in the paragraphs herein. At block S510, a status of the impact on fluid flow at the second node is dynamically provided for display, such as on a display of an electronic device of an operator. In some embodiments, additional information regarding the multi-well system including, but not limited to, proposed adjustments, rankings of the proposed adjustments based on one or more ranking types described herein, and operator adjustment modellings of the data model and physics model of the multi-well system are provided for display on an electronic device of the operator to help the operator determine whether to adjust the fluid flow at a particular node or at multiple nodes of the multi-well system.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, although the flowcharts depict a serial process, some of the steps/processes may be performed in parallel or out of sequence, or combined into a single step/process. The scope of the claims is intended to broadly cover the disclosed embodiments and any such modification. Further, the following clauses represent additional embodiments of the disclosure and should be considered within the scope of the disclosure.

Clause 1, a computer-implemented method to dynamically control fluid flow in a multi-well system, comprising: receiving first fluid flow data indicative of fluid flow at a first node of a plurality of nodes, each node being a node along a well of a plurality of wells of a multi-well system; receiving second fluid flow data indicative of fluid flow at a second node of the plurality of nodes; analyzing the first fluid flow data and the second fluid flow data; determining an impact on fluid flow at the second node due to fluid flow at the first node; determining, based on the impact, whether to adjust fluid flow at a node of the plurality of nodes; and in response to a determination to adjust fluid flow at the node: determining an adjustment to the fluid flow at the node; and requesting a fluid control device to make the adjustment.

Clause 2, the computer-implemented method of clause 1, further comprising: generating a data model of fluid flow in the multi-well system based on the first fluid flow data and the second fluid flow data, the data model being a modeling of the multi-well system generated from data indicative of fluid flow at the plurality of nodes, wherein determining the impact on fluid flow at the second node comprises determining, from the data model, the impact on the fluid flow at the second node due to fluid flow at the first node.

Clause 3, the computer-implemented method of clause 2, further comprising dynamically updating the data model with real-time data indicative of the fluid flow at the plurality of nodes.

Clause 4, the computer-implemented method of clauses 2 or 3, further comprising: obtaining a physics model of the fluid flow in the multi-well system, wherein determining the impact on fluid flow at the second node comprises determining, from the physics model, the impact on the fluid flow at the second node due to fluid flow at the first node.

Clause 5, the computer-implemented method of clause 4, further comprising dynamically updating the physics model with real-time data indicative of the fluid flow at the plurality of nodes.

Clause 6, the computer-implemented method of clauses 4 or 5, further comprising: obtaining a result of the physics model; and adjusting a parameter of the data model based on the result of the physics model.

Clause 7, the computer-implemented method of any of clauses 1-6, further comprising: determining one or more additional adjustments to the fluid flow at one or more nodes of the plurality of nodes; and ranking the adjustment and the one or more additional adjustments.

Clause 8, the computer-implemented method of clause 7, further comprising providing a recommendation including the ranking of the adjustment and the one or more additional adjustments for display on a display screen of an electronic device.

Clause 9, the computer-implemented method of clauses 7 or 8, wherein ranking the adjustment and the one or more additional adjustments comprises ranking the adjustment and the one or more additional adjustments based on an output of a desired fluid at the plurality of wells.

Clause 10, the computer-implemented method of any of clauses 1-9, further comprising predicting, based on the impact, future fluid flow through the plurality of nodes.

Clause 11, the computer-implemented method of any of clauses 1-10, further comprising determining, based on the first fluid flow data and the second fluid flow data, a relationship between the plurality of the nodes, wherein determining the impact on fluid flow at the second node due to fluid flow at the first node comprises determining, based on the relationship between the plurality of the nodes, the impact on the fluid flow at the second node due to the fluid flow at the first node.

Clause 12, the computer-implemented method of clause 11, wherein determining the impact on fluid flow at the second node due to fluid flow at the first node comprises determining, based on the relationship between the plurality of the nodes, whether the fluid flow through the first node causes an interference with the fluid flow through the second node.

Clause 13, the computer-implemented method of clause 12, wherein the fluid control device is a fluid restrictor, and wherein requesting the fluid control device to make the adjustment comprises dynamically requesting the fluid restrictor to reduce the fluid flow at the node to reduce interference with fluid flow through the second node.

Clause 14, the computer-implemented method of any of clauses 1-13, further comprising: determining, based on the first fluid flow data, a first boundary condition at the first node; and determining, based on the second fluid flow data, a second boundary condition at the second node.

Clause 15, the computer-implemented method of any of clauses 1-14, wherein the first node is along a first well of the plurality of wells, and wherein the second node is along a second well of the plurality of wells that is fluidly connected to the first well.

Clause 16, a computer-implemented method to dynamically provide a status of fluid flow in a multi-well system, comprising: receiving first fluid flow data indicative of fluid flow at a first node of a plurality of nodes, each node being a node along a well of a plurality of wells of a multi-well system; receiving second fluid flow data indicative of fluid flow at a second node of the plurality of nodes; analyzing the first fluid flow data and the second fluid flow data; determining an impact on fluid flow at the second node due to fluid flow at the first node; and dynamically providing a status of the impact on the fluid flow at the second node for display.

Clause 17, the computer-implemented method of clause 16, further comprising: generating a data model of fluid flow in the multi-well system based on the first fluid flow data and the second fluid flow data, the data model being a modeling of the multi-well system generated from data indicative of fluid flow at the plurality of nodes; and obtaining a physics model of the fluid flow in the multi-well system, wherein determining the impact on fluid flow at the second node comprises determining, from the data model and the physics model, the impact on the fluid flow at the second node due to fluid flow at the first node.

Clause 18, the computer-implemented method of clause 17, further comprising: determining one or more adjustments to the fluid flow at one or more nodes of the plurality of nodes; ranking the one or more adjustments; and providing a recommendation including the ranking of the one or more adjustments for display.

Clause 19, a multi-well fluid flow control system, comprising: a storage medium; and one or more processors configured to: receive first fluid flow data indicative of fluid flow at a first node of a plurality of nodes, each node being a node along a well of a plurality of wells of a multi-well system; receive second fluid flow data indicative of fluid flow at a second node of the plurality of nodes; analyze the first fluid flow data and the second fluid flow data; determine an impact on fluid flow at the second node due to fluid flow at the first node; determine, based on the impact, whether to adjust fluid flow at a node of the plurality of nodes; and in response to a determination to adjust fluid flow at the node: determine an adjustment to the fluid flow at the node; and request a fluid control device to make the adjustment.

Clause 20, the multi-well fluid flow control system of clause 19, wherein the one or more processors are further configured to: generate a data model of fluid flow in the multi-well system based on the first fluid flow data and the second fluid flow data, the data model being a modeling of the multi-well system generated from data indicative of fluid flow at the plurality of nodes; and obtain a physics model of the fluid flow in the multi-well system, wherein the impact on fluid flow at the second node are determined from the data model and the physics model.

As used herein, the singular forms "a", "an," and "the" are intended to include the plural forms as well, unless the context clearly indicates otherwise. It will be further understood that the terms "comprise" and/or "comprising," when used in this specification and/or in the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

What is claimed is:

1. A computer-implemented method to dynamically control fluid flow in a multi-well system, comprising:

receiving first fluid flow data indicative of fluid flow at a first node of a plurality of nodes, each node being a node along a well of a plurality of wells of a multi-well system;

receiving second fluid flow data indicative of fluid flow at a second node of the plurality of nodes;

analyzing the first fluid flow data and the second fluid flow data;

determining, based on the first fluid flow data and the second fluid flow data, a relationship between the plurality of the nodes, wherein determining the impact on fluid flow at the second node due to fluid flow at the first node comprises determining, based on the relationship between the plurality of the nodes, an impact on fluid flow at the second node due to fluid flow at the first node;

determining, based on the impact, whether to adjust fluid flow at a node of the plurality of nodes; and in response to a determination to adjust fluid flow at the node;

dynamically changing the fluid flow at the first node or at the second node to prevent crossflow.

2. The computer-implemented method of claim 1, further comprising:

generating a data model of fluid flow in the multi-well system based on the first fluid flow data and the second fluid flow data, the data model being a modeling of the multi-well system generated from data indicative of fluid flow at the plurality of nodes, wherein determining the impact on fluid flow at the second node comprises determining, from the data model, the impact on the fluid flow at the second node due to fluid flow at the first node.

3. The computer-implemented method of claim 2, further comprising dynamically updating the data model with real-time data indicative of the fluid flow at the plurality of nodes.

4. The computer-implemented method of claim 2, further comprising:

obtaining a physics model of the fluid flow in the multi-well system, wherein determining the impact on fluid flow at the second node comprises determining, from the physics model, the impact on the fluid flow at the second node due to fluid flow at the first node.

5. The computer-implemented method of claim 4, further comprising dynamically updating the physics model with real-time data indicative of the fluid flow at the plurality of nodes.

6. The computer-implemented method of claim 4, further comprising:

obtaining a result of the physics model; and adjusting a parameter of the data model based on the result of the physics model.

7. The computer-implemented method of claim 1, further comprising:

determining one or more additional adjustments to the fluid flow at one or more nodes of the plurality of nodes; and ranking the adjustment and the one or more additional adjustments.

8. The computer-implemented method of claim 7, further comprising providing a recommendation including the ranking of the adjustment and the one or more additional adjustments for display on a display screen of an electronic device.

9. The computer-implemented method of claim 7, wherein ranking the adjustment and the one or more additional adjustments comprises ranking the adjustment and the one or more additional adjustments based on an output of a desired fluid at the plurality of wells.

10. The computer-implemented method of claim 1, further comprising predicting, based on the impact, future fluid flow through the plurality of nodes.

11. The computer-implemented method of claim 1, wherein determining the impact on fluid flow at the second node due to fluid flow at the first node comprises determining, based on the relationship between the plurality of the nodes, whether the fluid flow through the first node causes an interference with the fluid flow through the second node.

12. The computer-implemented method of claim 11, wherein the fluid control device is a fluid restrictor, and wherein requesting the fluid control device to make the adjustment comprises dynamically requesting the fluid restrictor to reduce the fluid flow at the node to reduce interference with fluid flow through the second node.

13. The computer-implemented method of claim 1, further comprising:

determining, based on the first fluid flow data, a first boundary condition at the first node; and determining, based on the second fluid flow data, a second boundary condition at the second node.

14. The computer-implemented method of claim 1, wherein the first node is along a first well of the plurality of wells, and wherein the second node is along a second well of the plurality of wells that is fluidly connected to the first well.

15. A computer-implemented method to dynamically provide a status of fluid flow in a multi-well system, comprising:

receiving first fluid flow data indicative of fluid flow at a first node of a plurality of nodes, each node being a node along a well of a plurality of wells of a multi-well system;

receiving second fluid flow data indicative of fluid flow at a second node of the plurality of nodes;

analyzing the first fluid flow data and the second fluid flow data;

determining, based on the first fluid flow data and the second fluid flow data, a relationship between the plurality of the nodes, wherein determining the impact on fluid flow at the second node due to fluid flow at the first node comprises determining, based on the relationship between the plurality of the nodes, an impact on fluid flow at the second node due to fluid flow at the first node dynamically providing a status of the impact on the fluid flow at the second node for display, and dynamically changing the fluid flow at the first node or at the second mode to prevent crossflow.

16. The computer-implemented method of claim 15, further comprising:

generating a data model of fluid flow in the multi-well system based on the first fluid flow data and the second fluid flow data, the data model being a modeling of the multi-well system generated from data indicative of fluid flow at the plurality of nodes; and obtaining a physics model of the fluid flow in the multi-well system, wherein determining the impact on fluid flow at the second node comprises determining, from the data model and the physics model, the impact on the fluid flow at the second node due to fluid flow at the first node.

17. The computer-implemented method of claim 16, further comprising:

determining one or more adjustments to the fluid flow at one or more nodes of the plurality of nodes;

ranking the one or more adjustments; and providing a recommendation including the ranking of the one or more adjustments for display.

18. A multi-well fluid flow control system, comprising:

a storage medium; and one or more processors configured to:

receive first fluid flow data indicative of fluid flow at a first node of a plurality of nodes, each node being a node along a well of a plurality of wells of a multi-well system;

receive second fluid flow data indicative of fluid flow at a second node of the plurality of nodes;

analyze the first fluid flow data and the second fluid flow data;

determine, based on the first fluid flow data and the second fluid flow data, a relationship between the plurality of the nodes, wherein determining the impact on fluid flow at the second node due to fluid flow at the first node comprises determining, based on the relationship between the plurality of the nodes, an impact on fluid flow at the second node due to fluid flow at the first node;

determine, based on the impact, whether to adjust fluid flow at a node of the plurality of nodes; and in response to a determination to adjust fluid flow at the node;

dynamically changing the fluid flow at the first node or at the second node to prevent crossflow.

19. The multi-well fluid flow control system of claim 18, wherein the one or more processors are further configured to:

generate a data model of fluid flow in the multi-well system based on the first fluid flow data and the second fluid flow data, the data model being a modeling of the multi-well system generated from data indicative of fluid flow at the plurality of nodes; and obtain a physics model of the fluid flow in the multi-well system, wherein the impact on fluid flow at the second node are determined from the data model and the physics model.

* * * * *